US006288644B1

(12) United States Patent
Mathews et al.

(10) Patent No.: US 6,288,644 B1
(45) Date of Patent: Sep. 11, 2001

(54) PERIMETER MONITORING SYSTEM

(75) Inventors: Lester R. Mathews, Phoenix; Thomas E. Berk, Scottsdale; M. Shaun Farrier, Peoria, all of AZ (US)

(73) Assignee: Caretaker System, Inc., Scottsdale, AZ (US)

( * ) Notice: Subject to any disclaimer, the term of this patent is extended or adjusted under 35 U.S.C. 154(b) by 0 days.

(21) Appl. No.: 09/145,045

(22) Filed: Sep. 1, 1998

(51) Int. Cl.[7] ..... G08B 13/18
(52) U.S. Cl. ..... 340/555; 340/556; 250/559.45
(58) Field of Search ..... 340/555, 556, 340/557, 309.15; 250/222.1, 221, 347, 214 B, 559.45

(56) References Cited

U.S. PATENT DOCUMENTS 3,688,298 * 8/1972 Miller ..... 340/556
4,172,443 10/1979 Sommer .
4,186,388 * 1/1980 Robinson ..... 340/556
4,343,550 8/1982 Buckley et al. .
4,864,278 * 9/1989 Wiley ..... 340/555
4,998,093 * 3/1991 Benoit ..... 340/556
5,130,695 7/1992 Scarbrough et al. .
5,189,393 * 2/1993 Hu ..... 340/522
5,216,410 6/1993 Pildner et al. .
5,281,952 * 1/1994 Dragan ..... 340/546
5,506,567 * 4/1996 Bichlmaier ..... 340/555
5,508,511 4/1996 Zur et al. .
5,552,767 * 9/1996 Toman ..... 340/540
5,594,423 1/1997 East .

* cited by examiner

*Primary Examiner*—Jeffery Hofsass
*Assistant Examiner*—Anh La
(74) *Attorney, Agent, or Firm*—William R. Bachand; Stuart A. Whittington; Squire, Sanders & Dempsey L.L.P.

(57) ABSTRACT

A perimeter monitoring system is arranged to detect passage across a perimeter of an area. The system primarily includes an emitter, a retroreflector, a detector and an alarm. The emitter provides a modulated visible laser beam. The retroreflector is arranged to direct the beam along a segment of the perimeter and return the beam along the segment. The detector includes a device that blocks reception of light outside an angle of less than 5 degrees. One or more local or remote alarms are activated in response to the signal. For example, a remote alarm is located on the inside of a residence window where it is activated by another visible laser beam. Alignment of the peripheral monitoring system is less costly and false alarms are less likely than with known systems.

12 Claims, 10 Drawing Sheets

PERIMETER MONITORING SYSTEM

FIELD OF THE INVENTION

This invention relates to systems for monitoring a perimeter of an area and for reliably sounding an alarm in response to ingress or egress across the perimeter.

BACKGROUND OF THE INVENTION

As an introduction to the problems solved by the present invention, consider for example the conventional perimeter alarm system based on laser beam interruption as used to monitor ingress onto a swimming pool apron. Such a system is difficult to initially install and requires considerable maintenance to control the occurrence of false alarms.

Many different physical effects of the installation can independently effect a false alarm. For example, when infrared laser sources are used with several mirrors to create a continuous path around the perimeter to be monitored, the initial alignment of the laser sources and reflectors is costly. If any one source or mirror becomes misaligned, through sudden or gradual movement, the beam is interrupted as a false alarm. Correction of misalignment may require use of expensive infrared sensitive equipment. When the several mirrors are aligned sufficiently to remove the false alarm, one or more mirrors may not be positioned to reflect the beam from the center of the mirror. Consequently, the system's tolerance for future misalignment may be lower than expected.

The conventional detector for such a system may raise false alarms in response to light from sources other than from the laser source. Ambient sunlight may impinge upon the detector directly or as reflected by any surrounding surface or mirror. The angle of direct sunlight varies throughout the day and throughout the year to include a very wide range of angles. In addition, sunlight reflects from the surface of water in the swimming pool in an even wider range of angles varying randomly with wind conditions. The amount of background light on which a change is to be detected also varies making false detection more likely. An alignment of mirrors prescribed during installation or maintenance is unlikely to be sufficient for all of the above conditions.

The operator of such a system is exposed to risk of loss unnecessarily and possible responsibility for injury. As a result of false alarms, operators of such perimeter monitoring systems may be less likely to respond immediately when an alarm sounds. Failure to timely respond may result in a loss of life or property. When interrupted by a large number of false alarms, the operator may defeat the monitor or the alarm and not reactivate the monitor or the alarm due to operator irresponsibility or forgetfulness.

In view of the problems described above, the need remains in perimeter monitoring systems for higher reliability, greater safety, and lower installation and maintenance costs.

SUMMARY OF THE INVENTION

A perimeter monitoring system according to various aspects of the present invention includes a first and a second mounting apparatus, a reflector assembly, and a monitor. Each mounting apparatus includes a tube having an axial interior slot, and a pivot. The reflector assembly is positioned to receive a beam of light along a segment of a perimeter of an area to be monitored and to provide a returned beam. The reflector assembly includes a reflector secured to the pivot of the first mounting apparatus. The monitor includes an enclosure, an alarm controller, and a circuit board which includes an emitter and a detector. The emitter provides the beam of light. The detector provides a signal when an interruption of the returned beam is detected. The circuit board is mounted in the slot of the second mounting apparatus. The pivot of the second mounting apparatus is secured to the enclosure. The alarm controller activates an alarm in response to the signal.

By using a dual purpose mounting apparatus for the circuit board and for the reflector, installation is simplified and manufacturing costs are reduced. Initial set up and maintenance of such a system are greatly simplified by the use of visible light, use of a retroreflector, use of a dual purpose mounting apparatus and the combination of these features. Placement of reflectors in cooperation with the retroreflector is also simplified. The result is a much wider tolerance for misalignment of such reflectors and of the retroreflector, and consequently, a dramatic decrease in installation and maintenance costs.

According to various aspects of the present invention, a perimeter monitoring system includes: a reflector, a monitor, and a receiver. The reflector is positioned to receive a beam of light along a segment of a perimeter of an area to be monitored and to provide a returned beam. The monitor includes an emitter, a detector, an alarm, and a controller. The emitter provides the beam of light. The detector provides a first signal when an interruption of the returned beam is detected. The controller includes a timer that, when activated, reverts to being inactive after lapse of a period of time. The controller activates the alarm to provide a first warning when the timer is active and a second warning in response to the first signal when the timer is inactive. The controller activates the timer in response to a second signal provided by the receiver.

Use of such a system avoids periods without monitoring when an owner fails to reactivate the alarm after disabling the alarm. For example, when the timer is active, the first warning (e.g. a brief audible chirp) serves as a reminder that the first warning is disabled. When the timer has lapsed, the first warning is enabled, restoring monitoring with the second warning (e.g. a loud continuous tone).

In a variation, when an interruption of the returned beam is detected, the emitter is disabled for a period of time and then restarted.

In still another system according to various aspects of the present invention, a perimeter monitoring system includes: a reflector, a remote alarm, and a monitor. The reflector is positioned to receive a beam of light along a segment of a perimeter of an area to be monitored and to provide a returned beam. The remote alarm includes a remote transmitter that transmits a status signal and a remote receiver that receives an alert signal and activates a first alarm in response to the alert signal. The monitor includes an emitter, a detector, a second alarm, a transmitter, a receiver, and a controller. The emitter provides the beam of light. The detector provides a first signal when an interruption of the returned beam is detected. The transmitter transmits the alert signal in response to the first signal. The receiver provides a second signal in response to receiving the status signal. The controller includes a timer that provides a third signal in response to absence of the second signal for a period of time. The controller activates the second alarm to provide a first warning in response to the first signal when the timer is active, and activates the second alarm to provide a second warning in response to the third signal.

In addition to monitoring the perimeter, a system of the type described above makes known a condition wherein the remote alarm is not enabled. Such a condition includes, for example, silencing the remote alarm, loss of power to the remote alarm, and failure of the remote alarm.

DESCRIPTION OF THE DRAWING

Preferred exemplary embodiments of the present invention will be described in conjunction with the drawing, wherein.

DETAILED DESCRIPTION OF THE INVENTION

A system of the present invention includes any system for reliably monitoring passage across a segment of the perimeter of an area. Depending on the area to be monitored, some segments of the area may be determined to be more likely to be used for ingress or egress as opposed to other segments. For example, a reliable system may be installed to monitor only one segment, such as a doorway. The more problematic situation, however, arises in installations that monitor several segments, possibly forming polygonal series of segments to monitor ingress or egress along any direction. In such an installation, a system of the present invention may use a single enclosure for system electronic components to reduce manufacturing and installation expense. In other installations, multiple enclosures may monitor a respective one or series of segments.

Figure 1:
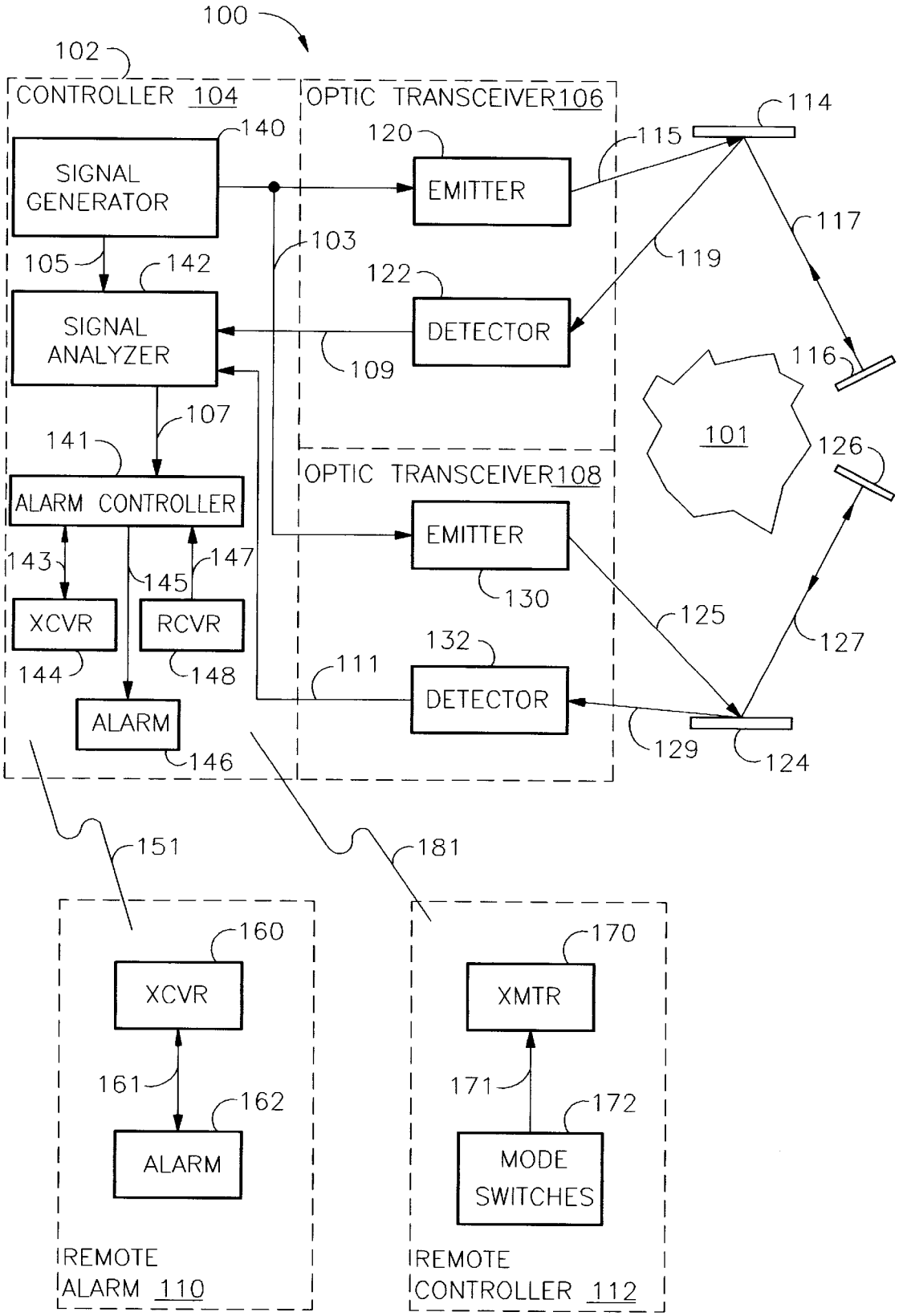
FIG. 1 is a functional block diagram of a system of the present invention.

For example, system 100 of FIG. 1 includes monitor 102 in a single enclosure that monitors a series of segments fully surrounding area 101. Area 101 may be any indoor and/or outdoor area which may be monitored for any purpose including for example personal safety, property protection, data security, or equipment configuration control. In operation, for example, an ingress into area 101 by passage across one (or more) segment(s) is detected as an interruption of a respective laser beam. Such interruption gives rise to an alarm condition. The possibility of false alarms as described in the background section is dramatically reduced.

In FIG. 1, the angles of incidence and reflection for mirrors 114 and 124 and the length of segments 115, 117, 119, 125, 127, and 129 are not to scale and are shown schematically for ease of description of operation. The physical distance between an emitter and a detector is usually quite small in comparison to the distance between an optic transceiver and a reflector. Therefore, for example, segments 115 and 119 (or 125 and 129) are essentially physically aligned, though in FIG. 1 they appear askew. Laser light is used in a preferred variation and is collimated through a lens, as discussed below. The lens creates a spot of light that increases in diameter with distance from the emitter. By the time the spot reaches the detector, at least a portion of the spot is visible to the detector at a short distance away from the center of the originally transmitted beam.

A monitor according to aspects of the present invention includes any device that transmits and receives one or more modulated laser beams, each beam being detected substantially in line with the transmitted beam. For example, monitor 102 includes in one enclosure controller 104, and optic transceivers 106 and 108. Controller 104 includes signal generator 140, signal analyzer 142, alarm controller 141, transceiver 144, local alarm 146, and receiver 148. Monitor 102 is constructed using conventional mechanical and electronic techniques except as discussed below.

Optic transceivers 106 land 108) respectively include an emitter 120 (130), and detector 122 (132). The structure and operation of optic transceivers 106 and 108 are preferably identical except as to physical positioning.

In operation, emitter 120 emits a beam of visible laser light that follows segment 115 toward mirror 114. The beam proceeds on segment 117 (by Snell's Law) toward retroreflector 116 and is reflected back along the same segment. A retroreflector conventionally includes an array of prisms for reflecting a beam back along the same segment, regardless of the angle the beam makes with the retroreflector. Upon second reflection by mirror 114, the beam follows segment 119 to detector 122. Detector 122 is preferably mounted close to emitter 120 so that at the focal length of the segments traversed, detector 122 receives a portion of the beam close to the center of the beam. For example, the spot size provided by emitter 120 may be in the range from 0.318 cm to 0.636 cm; and, the spot size received after a focal path of about 20 meters may be in the range from 7.6 cm to 10 cm. Mirrors and retroreflector(s) of any shape may be used, although first surface mirrors are preferred to avoid distortion of the spot size and shape. For example, for the spot sizes described above, mirrors and retroreflectors having facial dimensions of about 5.0 cm to 10 cm square may be used. For monitoring the perimeter of an outdoor water hazard, vertical misorientation has been found to be minimal in comparison with horizontal misorientation, due in part to wind effects. In such an installation, reflectors (mirrors or retroreflectors) about 5.0 cm high and about 16 cm wide (horizontal) are preferred. Use of a larger horizontal dimension simplifies installation by providing more area for reflection when the reflector is placed at an angle to the beam. Emitter 130, mirror 124, and detector 132 operate in an analogous fashion with retroreflector 126. The length of segments 115, 117, 125, and 127 may all be different from each other; however, the length of segments 115 and 119 (and by analogy 125 and 129) are substantially the same.

Initial installation is simplified by use of multiple beams, visible laser light, and retroreflectors. In a preferred installation, conventional beam power levels are used that are well below levels that could be unsafe to humans (e.g. toddlers) and animals (e.g. pets). For installation on level ground, as for an outdoor swimming pool within area 101, each beam (from emitter 120 and 130) is located parallel to and above the ground by a height in a range from 20 cm to 60 cm. The minimum height is preferred to protect pets and toddlers; whereas, the maximum height is preferred to protect children and adults who might inadvertently step over a low beam without interrupting it.

A method of installing system 100 according to aspects of the present invention includes the steps:

(a) placing and activating monitor 102, (b) placing reflectors 114, 116, 124, 126 at an acceptable elevation so that the beam will impinge on part of each reflector with a margin for vibration or shifting with time, (c) for each optic transceiver, activating the optic transceiver, adjusting the mounting apparatus for the optic transceiver to direct the emitted beam toward a reflector, then further adjusting the mounting apparatus to mechanically fix the position of the optic transceiver, and (d) for each reflector (e.g. mirror or retroreflector) adjusting the mounting apparatus for the reflector to direct the reflected (or returned) beam toward another reflector (or back toward the appropriate optic transceiver), then further adjusting the mounting apparatus to mechanically fix the position of the reflector.

Steps (a) and (b) may be performed in any sequence. In step (b), a suitable retroreflector for each beam or a common retroreflector may be desirable. In step (c), orienting optic transceiver 106 (or 108) accomplishes, in one motion, orienting both the emitter and detector, when these elements are in fixed relation to each other. Steps (c) and (d) do not require special equipment when visible low power laser light is emitted by the optic transceivers. Such light is easily scattered by briefly interrupting the beam with any object, for example, a small piece of paper (e.g. used in place of a reflector) or clothing.

A mounting apparatus, according to aspects of the present invention, includes any pivoted mounting device for supporting an optic transceiver or a reflector (e.g. a mirror or retroreflector). For example, system 200, of FIG. 2, includes enclosure 202 (housing monitor 102) and reflector assembly 260 positioned several meters away (distance not to scale). Within enclosure 202, optic transceiver 230 is supported by mounting device 218; and, an identical mounting device 228 supports reflector 244 of reflector assembly 260.

Each mounting device 218 (228) primarily includes base 216 (226), ball 214 (224), ring (212 (222), and tube 210 (220). Base 216 is attached to enclosure 202 by conventional screws 206 and 208. Base 226, on the other hand, provides a mounting surface for attachment of reflector 244 using a conventional adhesive. In operation, optic transceiver 230 is pivotally secured to enclosure 202 and reflector 244 is pivotally secured to capped post 240-242. To change the orientation of optic transceiver 230 and reflector 244, ring 212 (222) is loosened, tube 210 (220) is pivoted about ball 214 (224), and then ring 212 (222) is tightened to fix tube 210 (220) in relation to base 216 (226), obtaining a substantially permanent orientation.

Base 216 (226) includes a post on which ball 214 (224) is joined by conventional technique. In addition, each mounting device includes a ring 212 (222) and a tube 210 (220). When the base and ball are of plastic material, a suitable adhesive or welding process (e.g. sonic welding) may be used to join the base and ball. Prior to joining the base and ball, the ring is placed therebetween to become captive about the post.

In a variation, enclosure 202 is formed with an integral post to simplify assembly and thereby reduce production costs.

Ring 212 (222) operates to fasten tube 210 (220) in a rigid orientation suitable for monitoring a segment of the perimeter of an area to be monitored. Ball 214 (224) includes a suitable void 217 (227) that allows resilient compression of ball 214 (224) when ring 212 (222) is tightened to rigidly fasten tube 210 (220). Although conventional screw threads between ring and tube may be used as a fastening technique, variations employ other conventional fastening techniques including, for example, a bayonet joint or a joint having ridges. Although ring 212 (222) includes threads on an interior surface and tube 210 (220) includes mating threads on an exterior surface, variations employ features on an exterior surface of a ring with suitable features on a tube for compatibility.

Tube 210 (220) is generally cylindrical and includes slot 215 (225) for supporting a circuit board. Circuit board 250 is fixed into slot 215 by any conventional technique including, for example, friction fit and adhesive. Tube 220 fits snugly over the cylindrical exterior of post 240 prior to assembly of cap 242 on post 240. Screws 236 secure the orientation of tube 220 on post 240.

In variations, post 240 is plastic or metal pipe having any geometric cross section including circular, square, rectangular, or polygonal. Post 240 may be solid material or hollow (as shown). In systems based on such variations, a compatible interior shape for tube 220 is used.

For example, in variations, each tube is replaced with a cradle having an interior surface for contact against a suitable post. Such interior surface may be flat or suitably formed with an arc or with geometric angle(s). In such variations, each cradle is joined to the ball in any manner as shown or described above. Slot 215 may be absent and circuit board 250 may be fastened to the cradle in any conventional manner. When part of a reflector assembly, the cradle may be held against post 240 by any conventional technique including, for example, fasteners, circumferential bands, or adhesive.

In another variation, post 240 is formed with an integral surface (e.g. a socket) and fastening feature(s) for being urged against the ball.

In other variations, the ball and ring are captive to the tube (or cradle) and the base includes an integral surface (e.g. a socket) and fastening feature(s) for being urged against and fixed in relation to the ball.

It is preferred to use the identical part for tube 210 and tube 220 (as shown) to gain advantages of high volume production and reduced inventory.

Enclosure 202 includes bezel 204 through which laser light is transmitted and received. Enclosure 202 houses optic transceiver 230. A portion 280 of an emitted light beam from optic transceiver 230 passes through bezel 204 and illuminates reflector 244. A portion 282 of a resulting reflected beam passes through bezel 204 and is detected by optic transceiver 230.

An optic transceiver according to aspects of the present invention may be constructed with any physical arrangement of emitter and detector to provide isolation between the emitter and detector and to provide detection of returned energy. Electrical and optical cross-talk may be reduced in any conventional manner; however, such cross-talk may be advantageously reduced according to aspects of the present invention discussed below. For example, a partition may be introduced between the emitter and detector. Detection may be accomplished in any manner and may include optical structures (e.g., a lens, filter, and/or blocking device) as well as one or more electronic structures (e.g., a filter, isolator, and/or ground plane).

Figure 2:
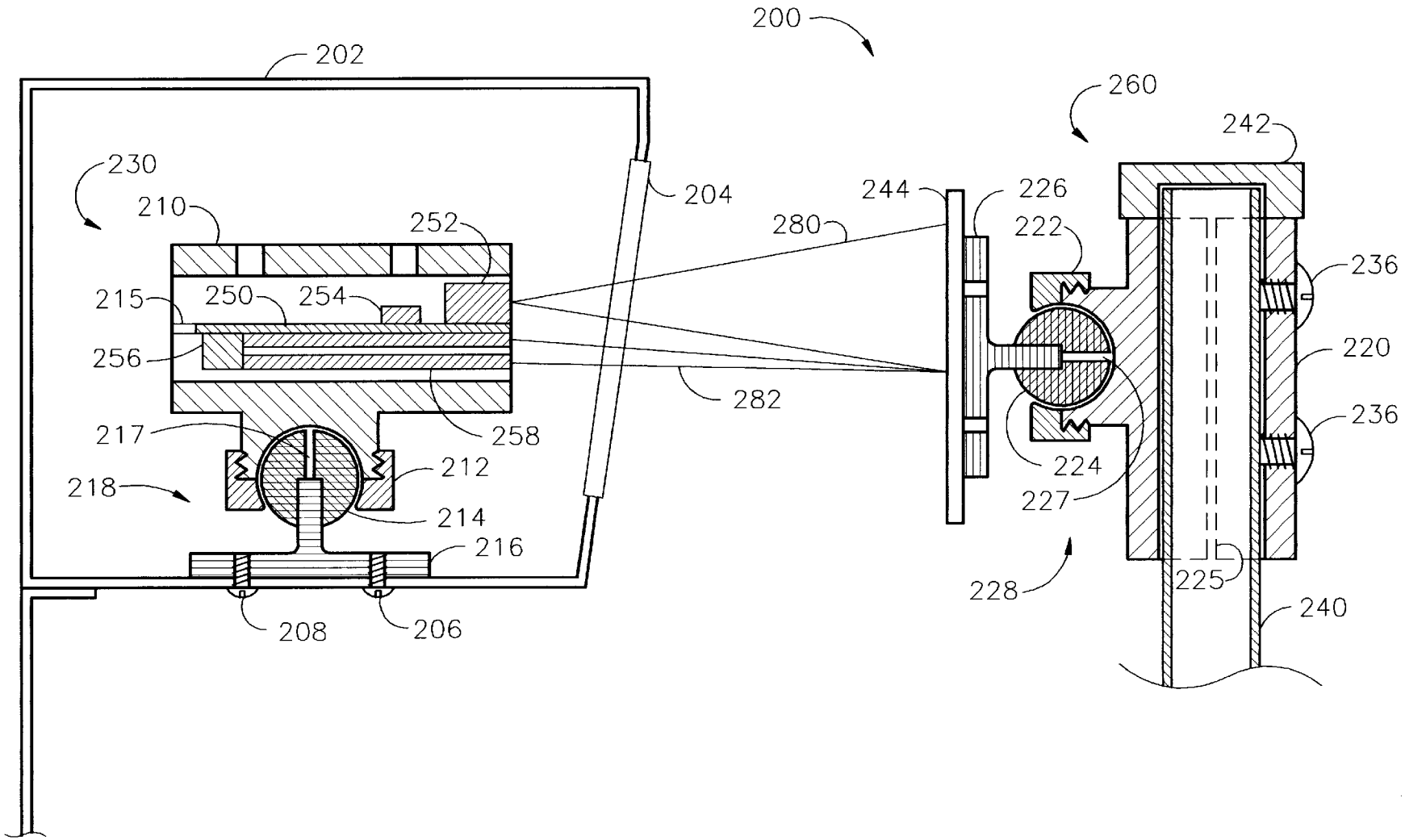
FIG. 2 is a cross section view of mounting apparatus of the present invention.

For example, optic transceiver 230, shown in cross section in FIG. 2, may be used for optic transceivers 106 and 108 in FIG. 1. Optic transceiver 230 primarily includes circuit board 250, integrated circuit 254, emitter module 252, detector module 256, and tube 258. Integrated circuit 254 is a conventional integrated circuit that generally represents all suitable circuitry for functional support for emitter module 252 and detector module 256. Circuit board 250 is opaque (e.g. of conventional copper and epoxy-glass constitution) and includes suitable signal layout features that electrically isolate signals for emitter and detector modules. Emitter module 252, mounted on the top side of circuit board 250 and at the edge closest to bezel 204, includes a conventional laser diode and lens sealed for mechanical stability in a clear plastic. In a variation, the lens is omitted and focusing is accomplished by the sealing material. Emitter 202 produces a visible beam of laser light on axis 216. Detector module 256, mounted on the bottom side of circuit board 250, includes a conventional photosensitive semiconductor (e.g., a photodiode, semiconductor switch, transistor, or darlington array), a lens, and a filter. In a variation, the lens and filter are omitted and focusing and filtering are accomplished by the sealing material.

Cross-talk between emitter module 252 and detector module 256 may be reduce in several ways. As shown, circuit board 250 forms an optical barrier between emitter module 252 and detector module 256. When both modules are mounted on the same side of circuit board 250, an opaque barrier is placed between them. Circuit board 250 is located within enclosure 202, formed in part by transparent bezel 204 on an angle to a reference plane parallel to circuit card 250. Optical isolation is enhanced by mounting emitter module 252 as close as possible to bezel 204. Further optical isolation is accomplished, as shown, by locating bezel 204 on an angle to the axis of the bore of tube 258. When such an angle is less than 90 degrees, preferably about 85 degrees, a reflected portion of the emitted beam is directed away from the axis. The inner surface of bezel 204 may be coated with a conventional impedance matching (anti-reflecting) substance to further reduce optical cross-talk.

A blocking device, according to aspects of the present invention, includes any apparatus that passes energy within a small angle from a central axis. For example, a blocking device used in optical transceiver 230 primarily includes tube 258. Tube 258 has length L and bore B selected to permit passage of light to detector module 256 in a narrow range of angles. Generally, the maximum angle measured to an axis of the bore for light reaching the front surface of detector module 256 is arctan(B/2L). Suitable allowances should be made for the position of the lens within detector module 256 (if any) and any reflections within the bore. The maximum angle (without accounting for reflections) is within a range from 5 degrees to 0.5 degree, preferably about 1.8 degrees. In other words, the ratio of B over 2L is in the range from 0.02 to 0.25, preferably about 0.03. In one variation where B is no more than 0.318 cm and L is no less than 5.0 cm, the maximum angle is about 1.8 degrees.

Figure 9:
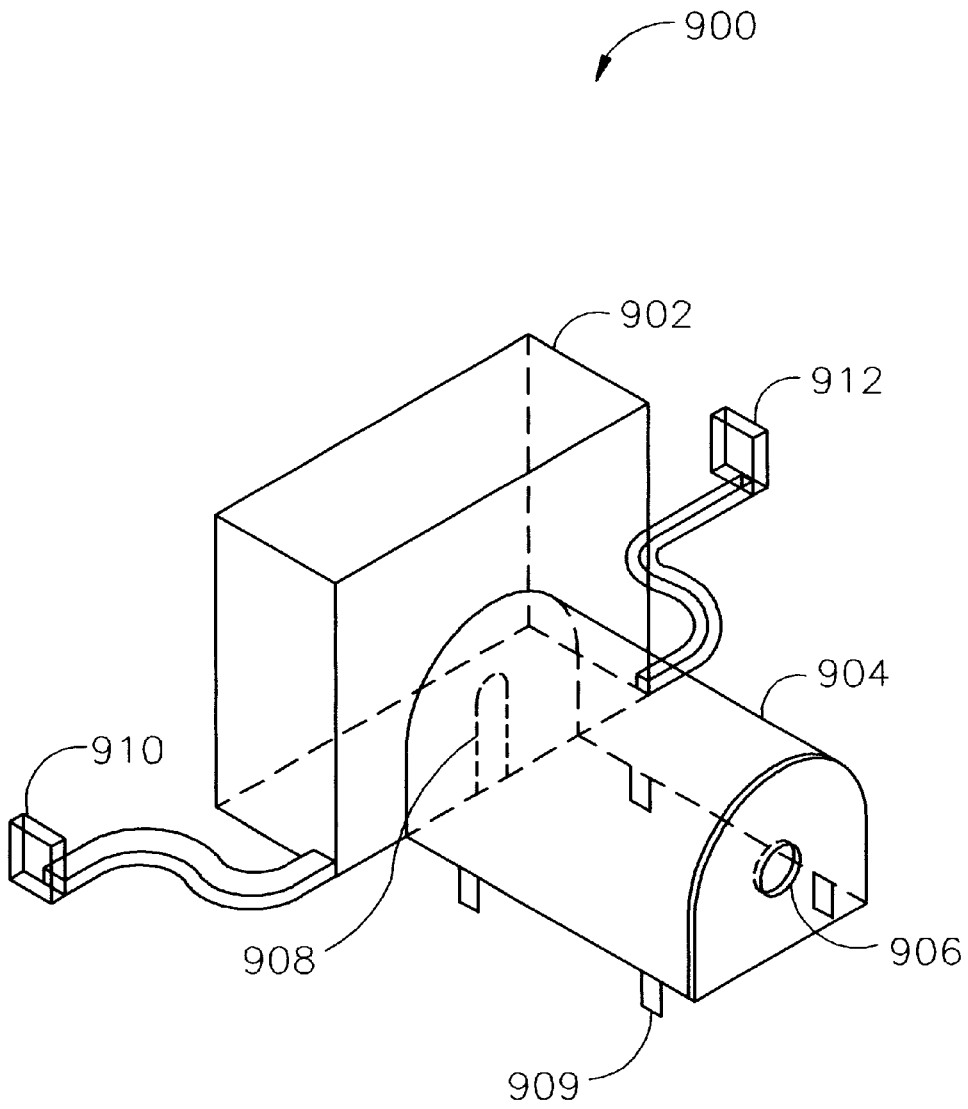
FIG. 9 is a perspective view of a blocking device according to various aspects of the present invention.

In a variation, a blocking device according to aspects of the present invention includes one or more conventional lenses and/or a passage or aperture placed prior to, between, or after such lens or lenses. For example, blocking device 900, of FIG. 9, is constructed of opaque plastic and includes two compartments. Compartment 902 surrounds detector module 256 except for slot 908 which admits light into detector module 256. Compartment 904 provides an elongated empty space somewhat analogous to the length L of tube 208, discussed above. Aperture 906 admits light into compartment 904. Blocking device 900 may be mounted against circuit board 250 using four feet 909 and an optic gasket or sealing material to assure that light that is received by the detector entered the compartment through aperture 906. When fixed to circuit board 250, blocking device 900 may perform a second function by locking circuit board 250 into position in a suitable mounting apparatus.

Figure 10:
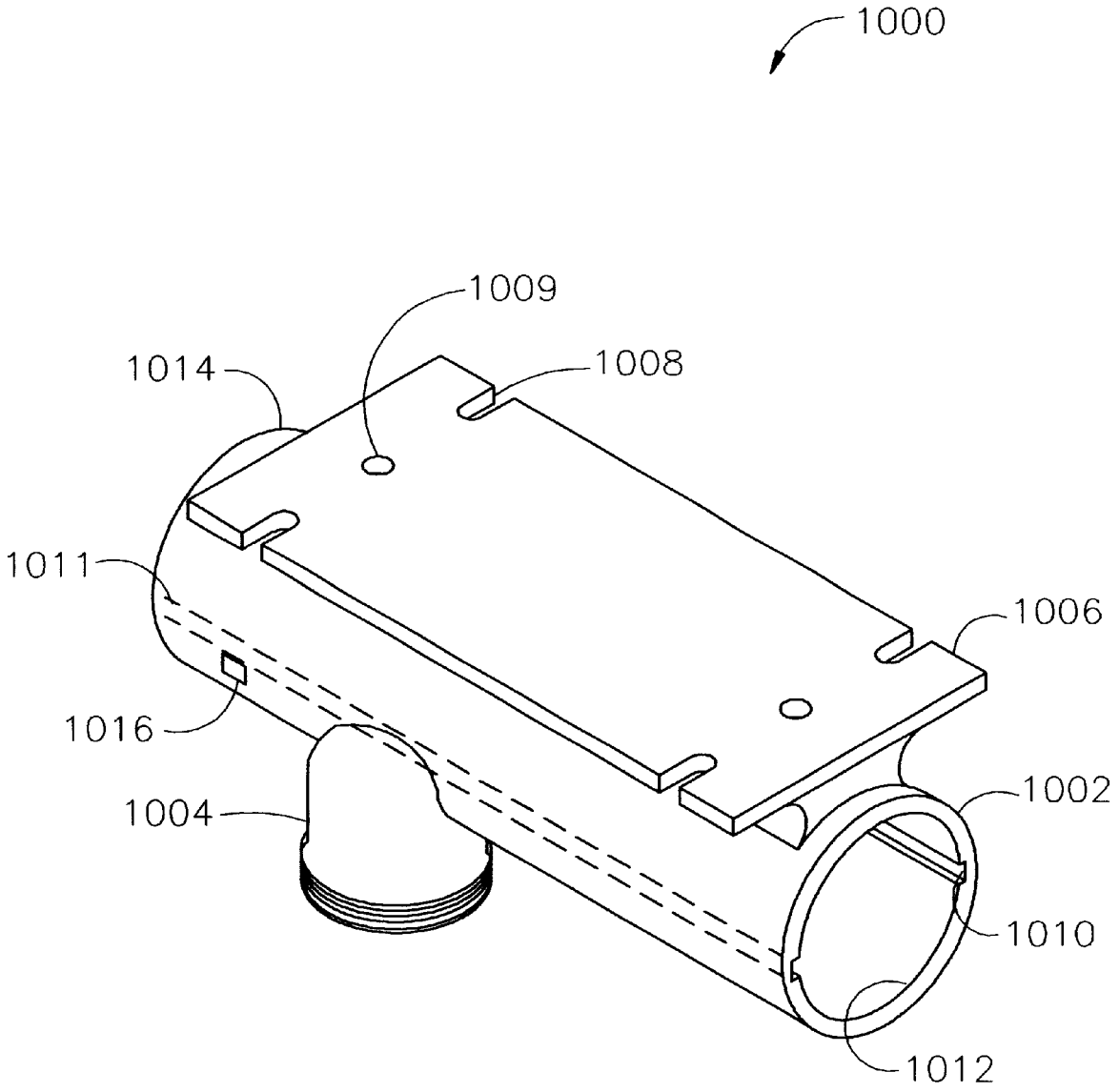
FIG. 10 is a perspective view of a portion of a mounting apparatus according to various aspects of the present invention.

For example, mounting apparatus 1000, of FIG. 10, includes tube 1002, socket portion 1004 of a ball joint, and flange plate 1006. Flange plate 1006 includes slots 1008 for mounting tube 1002 to a provided surface. Otherwise, threaded holes 1009 accept set screws for mounting tube 1002 on a pipe or conduit. Tube 1002 includes slots 1010 and 1011 for mounting circuit board 250. In addition, a pair of opposing holes 1016 located just beneath slots 1011 and 1010 accept locking tabs 910 and 912.

A detector, for example detector module 252, in operation within blocking device 900 is not responsive to light arriving at aperture 906 that is substantially off an axis defined as passing through aperture 906 to the detector. Off axis light is blocked or scattered. When blocking device 900 includes a filter at aperture 906 (or within compartment 904), the detector is responsive primarily to only a filtered component of the light arriving at aperture 906.

Accurate detection of portion 282 of the returned beam is enhanced by blocking light that is not within a narrow pass band of wavelengths common to the wavelength of the emitted beam. For example, when emitter module 252 emits red light having a wavelength of about 670 nanometers, a filtering bezel that optimally passes red light 10 having a wavelength of about 670 nanometers is preferred. When a clear bezel 204 is used, a colored filter at the entrance end of tube 258 may be used.

Due to operation of the blocking device of each optic transceiver, orientation of an optic transceiver and reflector is critical to reliable system operation. Such orientation is greatly simplified by the wide degree of adjustability and the simplicity of operation of the mounting apparatus discussed above. Further, the rigidity of such mounting apparatus reduces the possibility that transceivers or reflectors may become misoriented. Consequently, installation and maintenance (if any) of a system of the present invention is accomplished at lower cost than realized by known systems.

Each laser beam used along a segment about an area to be monitored may be modulated. Any conventional modulation may be used to reduce power consumption, reduce average power level, or improve the reliability of detection. Modulation may include a combination of conventional techniques including: pulsing the beam on for a short period of time regularly or in a pseudo random manner; providing a burst of such pulses; amplitude modulating the beam to convey one or more periods of a pulse, sinusoid, or complex waveform; frequency modulation of the beam; or frequency or phase shift modulation of a signal conveyed by amplitude modulation.

For example, in system 100, emitters 120 and 130 respond to signal generator 140 via signals on line 103 to pulse modulate respective beams at a constant rate and constant duty cycle. Beams are off during a portion of each duty cycle. Each detector 122 and 132 provides a detector output signal DO respectively on lines 109 and 111 to signal analyzer 142.

Signal DO includes a regular period which in turn includes a first duration when received light exceeds a minimum (e.g. a constant threshold value), and a second duration when received light does not exceed the minimum. For monitoring a perimeter near an outdoor swimming pool, the regular period is preferred to be about 6 msec. Regardless of the period, the duty cycle (first duration divided by the regular period) may be about 50 percent.

A signal analyzer according to aspects of the present invention includes any conventional circuit that raises an alert condition in response to the absence of an expected feature of an input signal. Such an absence is generally assumed to coincide with interruption of one or more beams. For example, an alert condition may be raised by signal analyzer 142 with reference to signal DO discussed above when the first duration exceeds one or more times the duration of the regular period.

In one variation, signal analyzer 142 compares a signal on line 105 (provided by signal generator 140) to the signals on lines 109 and 111 (provided by detectors 122 and 132). In a second variation, line 105 is omitted and signal analyzer 142 compares signals 109 and 111. In each of these variations, a difference between compared signals may be used to trigger a timer (or counter) to detect lapse of a period of time having an absence of an expected pulse.

In another variation, when line 105 is omitted, signal analyzer 142 includes a separate independent logic circuit for each optic transceiver (up to a maximum, such as 8). Each logic circuit includes a timer that raises an alert condition if not retriggered within a maximum time duration e.g., 7 periods).

The time duration discussed above as a number of periods of signal DO during which an expected pulse is not received may be set to a predetermined time irrespective of the duration of the regular period of signal DO. For example, a time duration of about 10 msec to about 50 msec is satisfactory. Less than 10 msec may be undesirable as it may permit heavy rain to activate the alarm. About 50 msec is sufficient to avoid false alarms that could be raised for blowing debris and birds flying through the beam. It is preferred to set the time duration, lapse of which raises an alert condition, in the range from 35 msec to 45 msec, preferably 40 msec for protecting the perimeter of an outdoor water safety hazard from entry by children.

When an alert condition is raised, according to aspects of the present invention, any number of local and/or remote alarms may be activated. A system of the present invention includes any system that selectively activates one or more alarms via one or more communication links. For example, signal analyzer 142, in response to detecting interruption of a beam as discussed above, provides a signal on line 107 to alarm controller 141. Consequently, alarm controller 141 may provide a signal on line 145 to activate local alarm 146 and a signal on line 143 to transceiver 144 for communicating a message via link 151 to activate one or more remote alarms 110.

The signal on line 145 activates alarm 146. Alarm 146 may be any conventional audio and/or visual alarm for providing one or more warnings.

Remote alarm 110 includes transceiver 160 and alarm 162. On detection of a suitable message or signal via link 151, transceiver 160 activates alarm 162 by a signal on line 161. Alarm 162 includes an audible and/or visual alarm, or any conventional alarm for providing one or more warnings. In a variation, alarm 162 includes downlink capability (not shown) to place a telephone call to a predetermined party for logging, awareness, or emergency response. In another variation remote alarm 110 is of the type described as a conventional pager that warns the user by vibrating.

For failsafe operation, transceiver 160 may activate alarm 162 in response to detecting an absence of signal from transceiver 144. When activated, alarm 162 may provide a different warning than the warning discussed above with reference to beam interruption. In addition, transceiver 160 may provide a status signal or message via link 151 for reception by transceiver 144 to indicate status of remote alarm 110. Status may include indicia of time of day for system synchronization, signal strength received by remote alarm 110, and/or condition of power available to remote alarm 110. When transceiver 144 receives such a status message, transceiver 144 may provide a signal on line 143 to alarm controller 141. In response to detecting an absence of such a signal from transceiver 144, alarm controller 141 may activate alarm 146 to provide a different warning than the warning discussed above with reference to beam interruption.

In a preferred variation, transceivers 144 and 160 communicate via modulated laser light through the window of a building such as a residence. Transceivers 144 and 160 cooperate using any modulation described above with reference to optic transceiver 106, or any conventional modulation. Remote alarm 110 preferably includes a fastener for attaching remote alarm 110 to the window. When used on the window of a residence, alarm 162 may be more effective (audible, visible, etc.) to residents than alarm 146. Alarm 162 also provides redundancy to alarm 146.

From time to time it may be desirable to deactivate alarms 146 and/or 160 for all or selected warnings. According to various aspects of the present invention, an alarm may be deactivated by operation of a local or remote control. For example, alarm controller 141 may include one or more local mode control switches, operation of which may deactivate alarm 146 and/or 160 for only the beam interruption warning. Further, system 100 may include one or more remote controllers 112 from which deactivation of alarm(s) may be initiated at a convenient distance from monitor 102.

Remote controller 112 includes mode switches 172, and transmitter 170 and may be operated from a fixed or portable location. In operation, manual operation of one or more mode switches 172 provides a signal on line 171 to transmitter 170. Transmitter 170 sends a signal or message via link 181 to receiver 148. Receiver 148, on detecting a signal or message via link 181 provides a signal on line 147 to alarm controller 141. Alarm controller 141 may respond to such a signal on line 147 in the manner described above with reference to local mode control switches. Transmitter 170 and receiver 148 may communicate via link 181 in any conventional manner. It is preferred to use conventional low power radio communications with suitable conventional circuitry in remote controller 112 and receiver 148.

An alarm controller of the present invention includes any analog or digital control circuit for selectively activating and deactivating one or more alarms. For example, alarm controller 141 includes a microprocessor circuit for performing a stored program with reference to instructions and data stored in memory devices.

Figure 3:
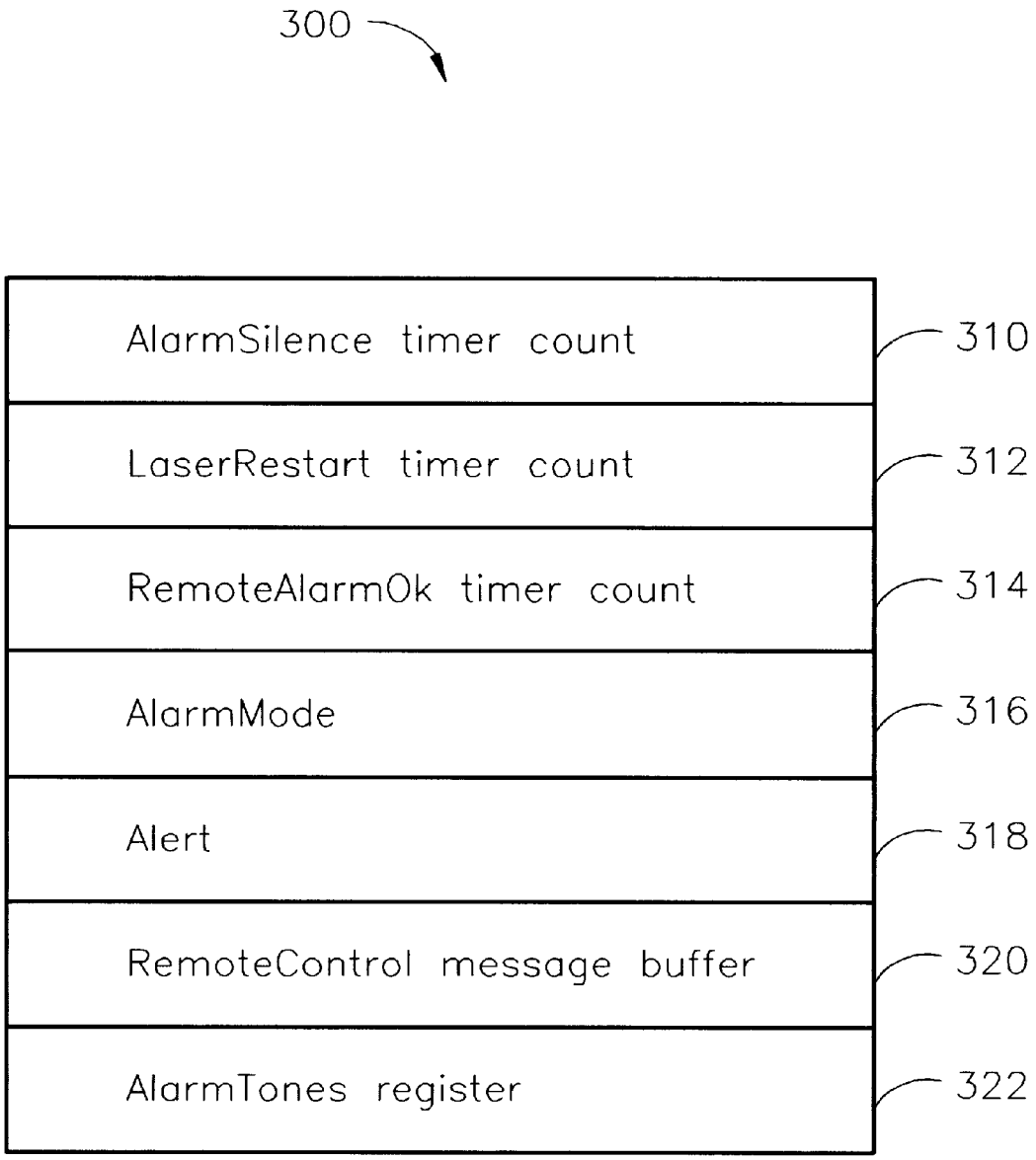
FIG. 3 is a partial memory map in one embodiment of the present invention.

The contents of memory devices may be described by a memory map and/or a list of variables used in a programming language for generating microprocessor instructions. For example, partial memory map 300, of FIG. 3, describes a portion of a random access memory device of alarm controller 141. Memory map 300 includes AlarmSilence timer count 310, LaserRestart timer count 312, RemoteAlarmOk timer count 314, AlarmMode 316, Alert 318, RemoteControl message buffer 320, and AlarmTones register 322. In variations, these data items may be stored in any order and in other devices than random access memory. For example, for a microprocessor having hardware timer circuits, timer counts may be stored in respective counters; and, for a microprocessor having audio signal generation support circuits, AlarmMode and AlarmTones may be stored in discrete registers. When alarm controller 141 includes a microcontroller integrated circuit, some or all of these memory devices may be integrated with the processor and read-only memory used for storage of program instructions.

When AlarmTones register 322 is set to a value of Tone1, local alarm 146 is activated to provide a continuous shrill warning. Tone1 is used as a warning for beam interruption as discussed below with step 718 of FIG. 7. When AlarmTones register 322 is set to a value of Tone2, local alarm 146 is activated to provide a repeated series of short chirp sounds. Tone2 is used as a warning from local alarm 146 regarding remote alarm 110 as discussed above, for example, limited power or interruption of communication. Tone3 is used as a reminder warning from remote alarm 160 that selected alarms or warnings have been deactivated. Tone4 is used as a reminder warning from local alarm 146 that selected alarms or warnings have been deactivated for a relatively short time. Tone5 is used as a reminder warning from local alarm 146 that selected alarms or warnings have been deactivated for a relatively long time. Multiple tone commands may result in simultaneous combination of tones or patterns, alternating between tones or patterns, or provision of only the higher priority of requested tones. Such a priority may, for example, place higher emphasis for immediate response on a beam interruption than on a low power condition in a remote alarm; or, vice versa.

Figure 4:
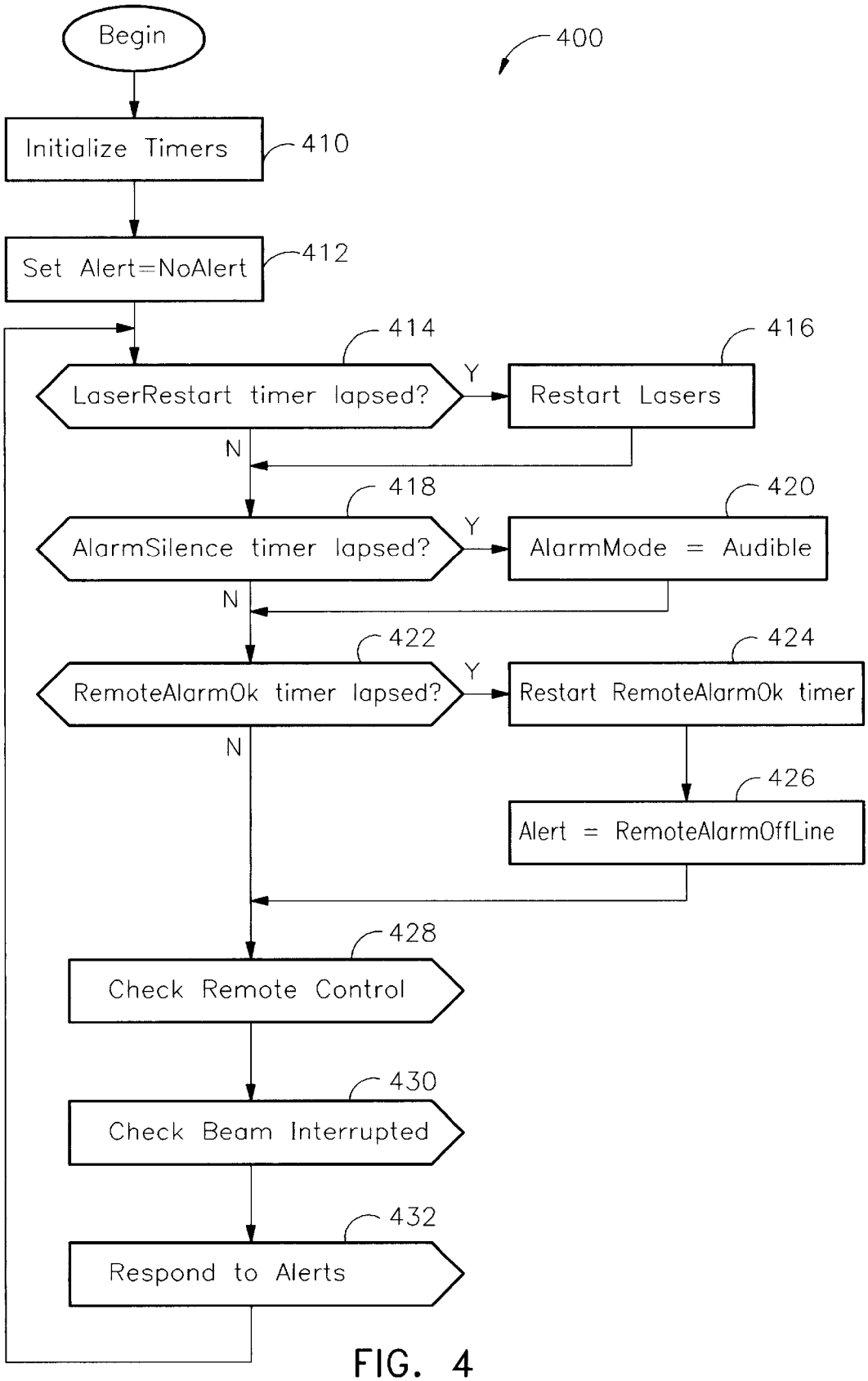
FIG. 4 is a flow diagram for a method in one embodiment of the present invention.

Method 400, of FIG. 4, is an example of a method of alarm control according to various aspects of the present invention for execution by alarm controller 141 of system 100. Instructions for performing such a method may be generated in any conventional manner for any particular alarm controller circuit. After initialization, operation continues in an infinite loop that includes three subroutines. The sequence of operations and the partitioning of the method into subroutines herein is for convenience of description. Other sequences and other partitionings are used in variations.

At step 410, timers are initialized as to initial (or limit) value, whether to begin or resume counting, the direction of counting, and (when initialized in a stopped condition) whether to indicate that the count has lapsed or not. At step 410, AlarmSilence timer count 310 is cleared, the timer is stopped, and the lapsed flag is set; LaserRestart timer count 312 is cleared, the timer is stopped, and the lapsed flag is set; and, RemoteAlarmOk timer count 314 is set to correspond to 30 minutes, and the timer is started.

At step 412, a variable that dictates one of three alert conditions is set. Alert 318 is set to NoAlert, an arbitrary constant used to designate that no alert conditions are currently being detected. In a variation, one or more alert conditions once raised each set a latch that must be cleared by operator intervention. For system 100, Alert 318 may have the value NoAlert or the value RemoteAlarmOffLine and/or Beaminterrupted.

At step 414, it is determined whether LaserRestart timer 312 has lapsed. If so, for example as a consequence of timer initialization, lasers are restarted at step 416. In system 100, each optic transceiver includes a laser emitter that is activated at this step 414. By turning off lasers, for example at step 643 of FIG. 6, discussed below, power may be conserved and personnel safety may be enhanced. If LaserRestart timer 312 has not lapsed, lasers are presumed to be operating and control passes to step 418.

At step 418, it is determined whether AlarmSilence timer 310 has lapsed. If so, AlarmMode 316 is set to an arbitrary constant used to designate that alarms 146 and 160 are to be in their fully audible/visible mode of operation when activated. For system 100, AlarmMode 316 may have one of the values: Audible, ShortSilence, or LongSilence. Operation of steps 418 and 420 provides a controller having a timer that, when activated, reverts to being inactive after lapse of a period of time. Reversion to inactive status is accomplished by leaving AlarmSilence timer 310 in a stopped condition after AlarmMode 316 has been set to Audible. If AlarmSilence timer 310 has not lapsed, control passes to step 422.

At step 422, it is determined whether RemoteAlarmOk timer 314 has lapsed. If so, RemoteAlarmOk timer 314 is restarted at step 424 from the initial time set in step 410; and, Alert is set to an arbitrary constant used to designate that remote alarm 110 is no longer providing status messages, as discussed above. Alarms may be activated in response to this value of Alert as will be discussed below. Operation of RemoteAlarmOk timer 314 corresponds to operation of a conventional "watch dog" timer. RemoteAlarmOk timer 314 is ordinarily restarted at step 524, of FIG. 5, discussed below.

At step 428, the Check Remote Control subroutine is performed primarily to check operation of and respond to messages from remote control 110. This subroutine is described below with reference to FIG. 5. Upon return from this subroutine, control passes to step 430.

At step 430, the Check Beam Interrupted subroutine is performed primarily to determine whether any beam used for perimeter monitoring has been interrupted for a time sufficient to indicate an alert condition should be raised. This subroutine is described below with reference to FIG. 6. Upon return from this subroutine, control passes to step 432.

At step 432, the Respond to Alerts subroutine is performed primarily to activate alarms. This subroutine is described below with reference to FIG. 7. Upon return from this subroutine, control passes back to step 414, the top of an infinite loop.

Figure 5:
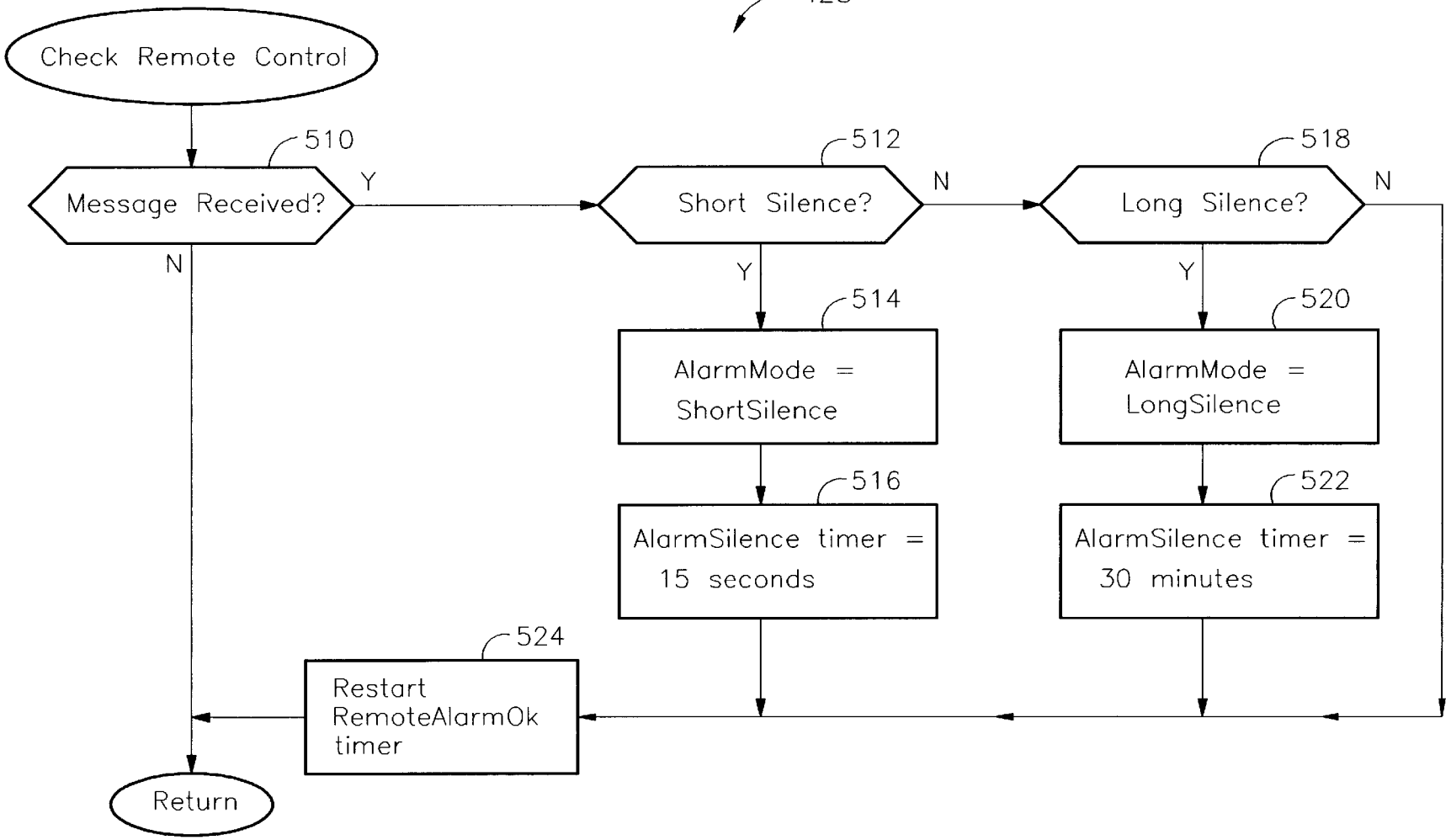
FIGS. 5, 6, and 7 are flow diagrams for portions of the method of FIG. 4.

Method 428, of FIG. 5, is an example of a method of checking operation of remote control 110 according to various aspects of the present invention. In a variation having multiple remote controls, the steps described in FIG. 5 are repeated for each remote control.

At step 510, it is determined whether a message has been received by receiver 148 and placed by receiver 148 (or by, for example, an interrupt service routine) in RemoteControl message buffer 320. If so, control passes to step 512. If not, control passes by a return instruction back to the calling program.

At step 512, it is determined whether the message in RemoteControl message buffer 320 includes indicia of a request or command to silence alarms for a relatively short period of time. If so, control passes to step 514. If not, control passes to step 518.

Figure 7:
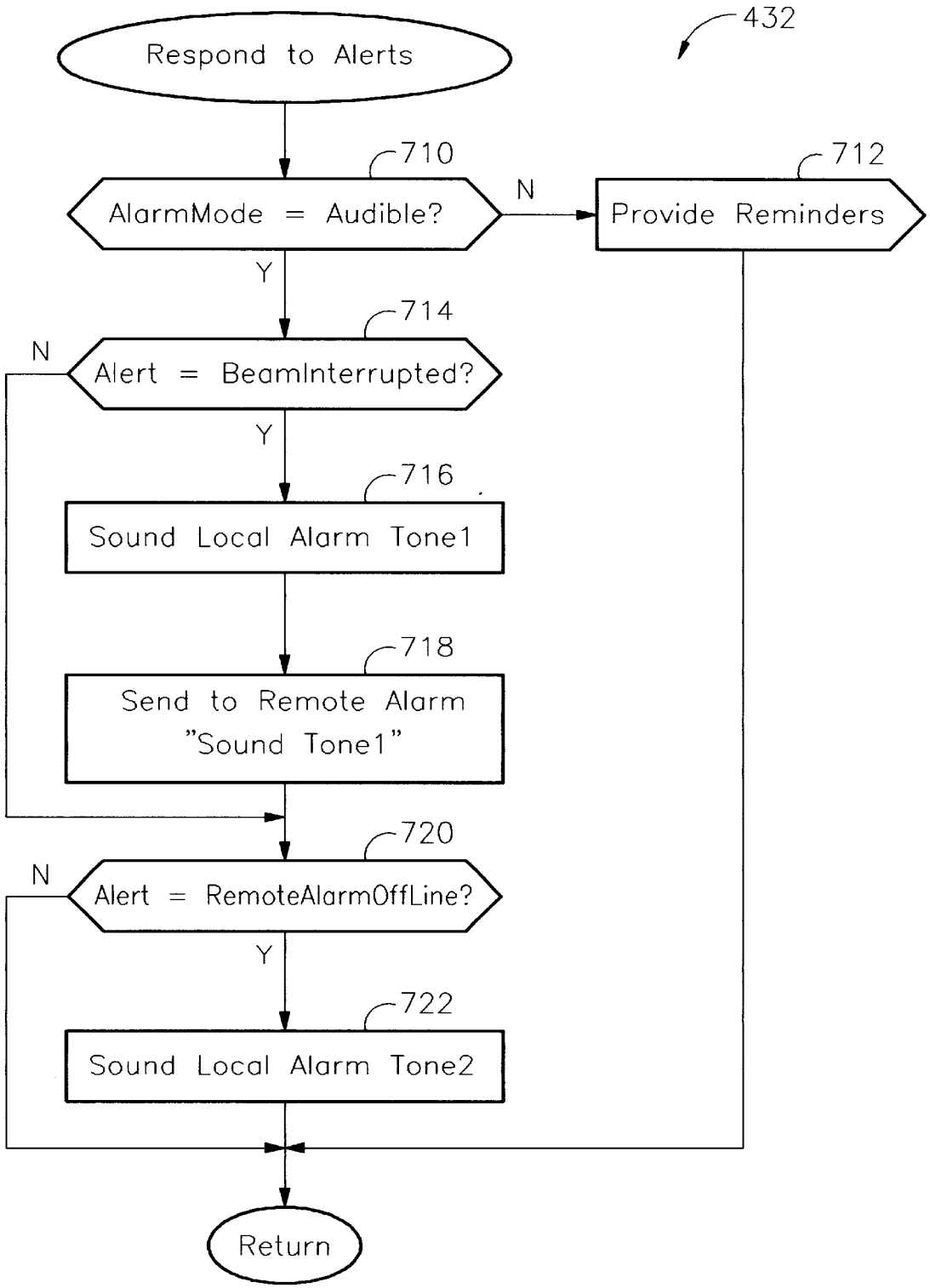

At step 514, AlarmMode is set to the value corresponding to ShortSilence, a value that is mutually exclusive of the value Audible tested at step 710 of FIG. 7. Control then passes to step 516.

At step 516, AlarmSilence timer 310 is started with a value corresponding to 15 seconds. By operation of step 418, alarms will no longer be silenced after lapse of 15 seconds. Control then passes to step 524.

At step 518 it is determined whether the message in RemoteControl message buffer 320 includes indicia of a request or command to silence alarms for a relatively long period of time. If so, control passes to step 520. If not, control passes to step 524.

At step 520, AlarmMode is set to the value corresponding to LongSilence, a value that is mutually exclusive of the value Audible tested at step 710 of FIG. 7. Control then passes to step 522.

At step 522, AlarmSilence timer 310 is started with a value corresponding to 30 minutes. By operation of step 418, alarms will no longer be silenced after lapse of 30 minutes. Control then passes to step 524.

At step 524, RemoteAlarmOk timer 314 is restarted from the initial value used in step 410. A status message that does not include indicia of the requests or commands discussed above will none the less restart RemoteAlarmOk timer 314 to avoid the RemoteAlarmOffLine alert condition from being raised, for example, at step 426.

Figure 6:
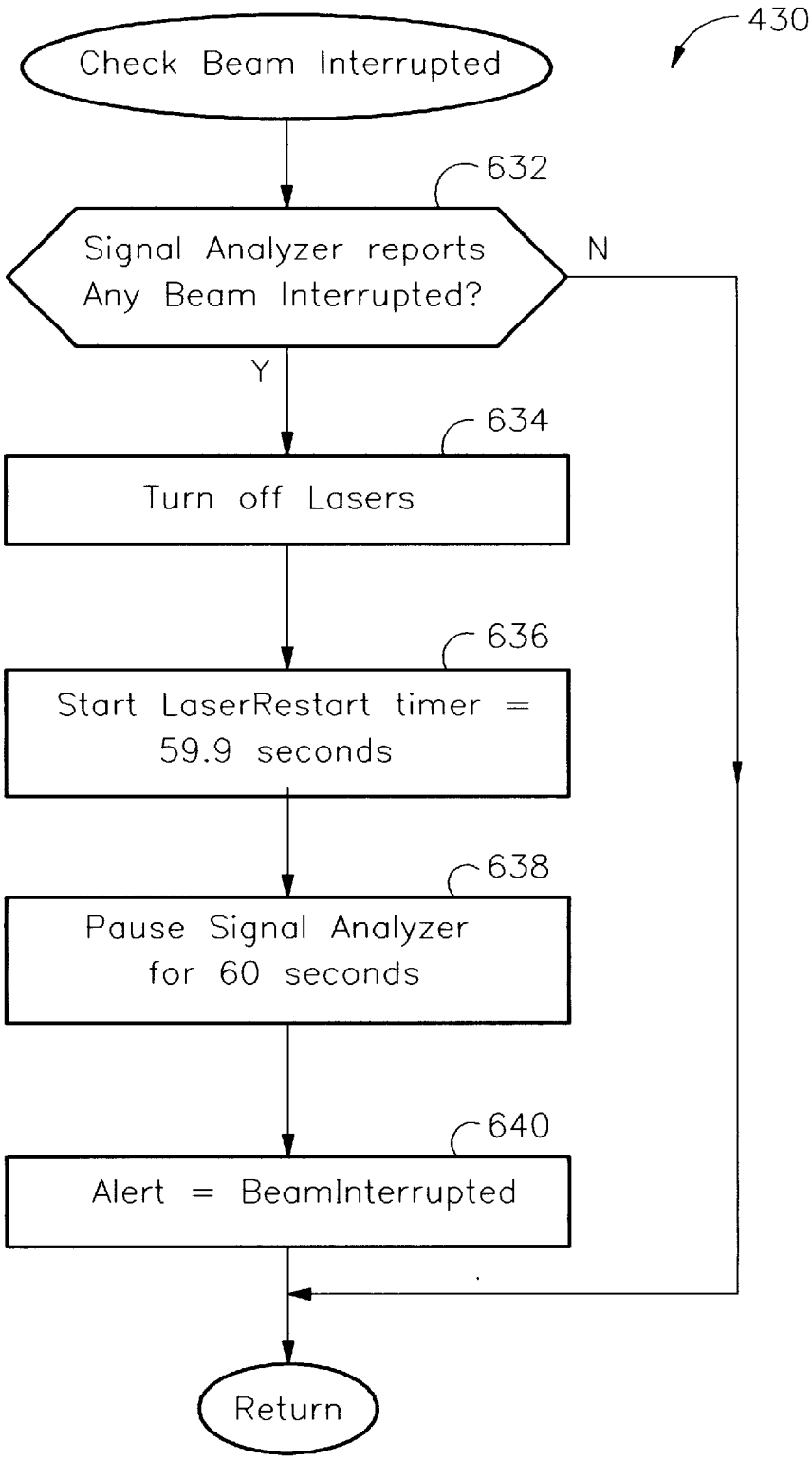

Method 430, of FIG. 6, is an example of a method of checking and responding to interruption of beams along segments 117, 119, 127, and 129 of system 100 according to various aspects of the present invention.

At step 632, it is determined whether signal analyzer 142 is currently (or has a latched condition) reporting that any beam has been interrupted. This determination is made with reference to a signal on line 107 as discussed above. If not, control passes by the return instruction back to the calling program. If so, control passes to step 634.

At step 634, laser light emission from emitters 120 and 130 is stopped for a period of time controlled by LaserRestart timer 312. Control then passes to step 636.

At step 636, LaserRestart timer is started with an initial (limit) value corresponding to 59.9 seconds. By restarting emission on lapse of the LaserRestart timer, as in step 416, monitoring by system 100 continues, perhaps with the immediate recognition of another beam interruption condition brought on by failure of the obstruction in the beam to move or be moved. By stopping emission of laser light in step 634, absorption of laser light energy by the obstruction will be limited to a minimum. After step 636, control passes to step 638.

At step 638, signal analyzer 142 is paused for 60 seconds. Accordingly, no further signal on line 107 related to beam interruption is provided by signal analyzer 142. Signal analyzer 142 includes a timer that suspends provision of a signal related to detection of beam interruption on line 107 for a predetermined time (e.g. 60 seconds). In a variation, alarm controller 141 includes a timer for ignoring beam interruption alert conditions. When signal 107 provides a program interrupt to alarm controller 141, such a timer may control masking of such an interrupt. When such a timer or combination of timers has lapsed, an alert condition related to beam interruption may again be raised and processed. After step 638, control passes to step 640.

At step 640, Alert 318 is set to Beaminterrupted, an arbitrary constant designating that one or more beams have been interrupted by an obstruction. Following step 640, control passes by return instruction back to the calling program.

Method 432, of FIG. 7, is an example of a method of responding to alert conditions of system 100 according to various aspects of the present invention. In the discussion below, alarms are described as audible, although visual and other conventional alarms may be substituted or used in combination.

At step 710, it is determined whether AlarmMode 316 is currently set to Audible. If not, as in the case where it is set to ShortSilence or LongSilence, control passes to step 712 and then to the Provide Reminders subroutine, discussed below with reference to FIG. 8. If AlarmMode 316 is set to Audible, control passes to step 714.

At step 714, it is determined whether Alert 318 is currently set to Beaminterrupted. If not, control passes to step 720. If so, local alarm 146 is activated at step 716 using Tone1 as discussed above. In addition, a message is sent to one or more remote alarms 110 with indicia of a request or command to sound Tone1 at each remote alarm. Control passes then to step 720.

At step 720, it is determined whether Alert 318 currently has the value RemoteAlarmOffLine. If not, control passes by return instruction back to the calling program. If so, local alarm 146 is activated using Tone 2, as discussed above; then, control passes back to the calling program.

Figure 8:
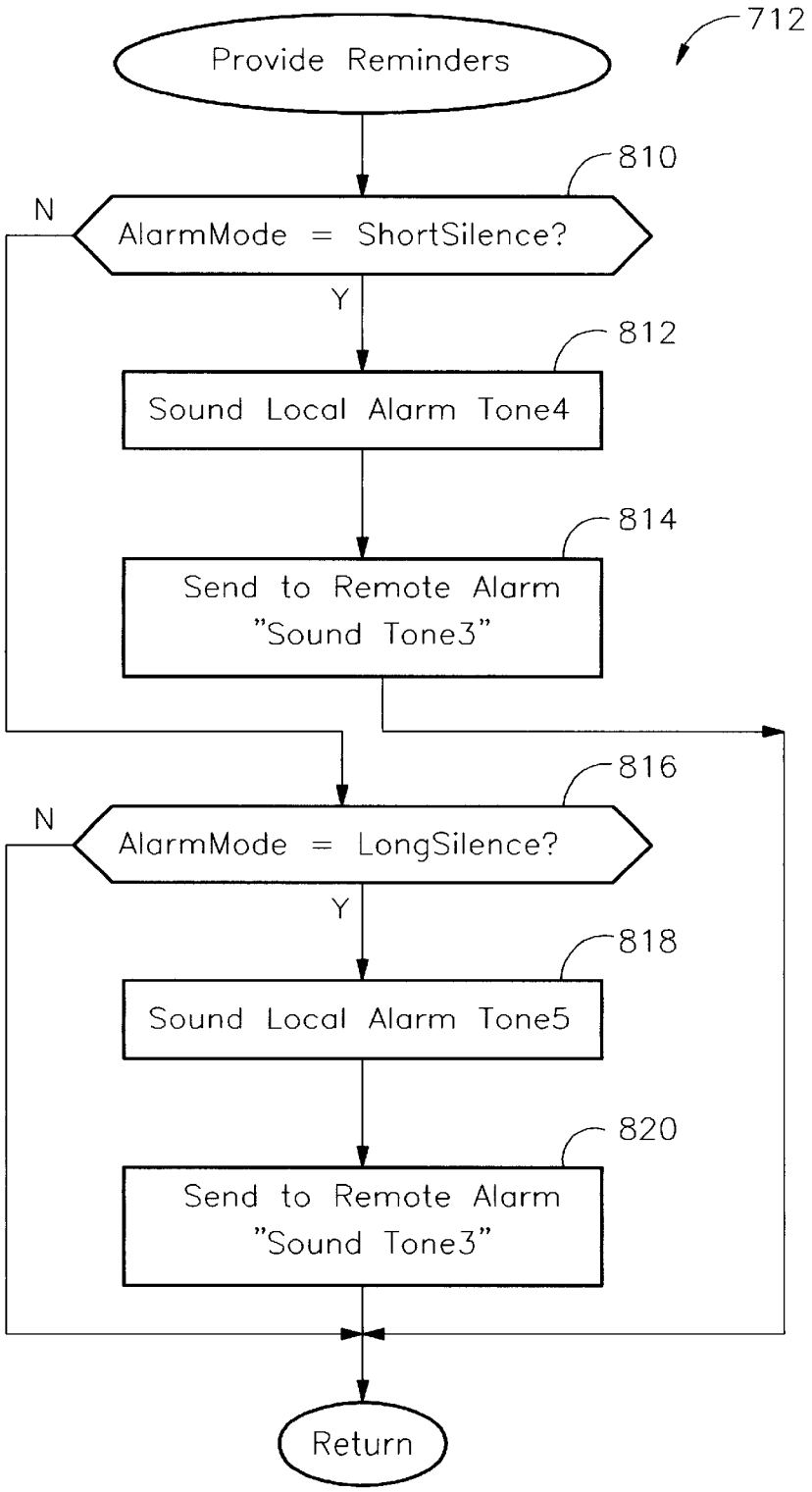
FIG. 8 is a flow diagram for a portion of the method of FIG. 7.

Method 712, of FIG. 8, is an example of a method of providing reminders to an operator of system 100 according to various aspects of the present invention. Reminders inform the operator that normal peripheral monitoring with remote alarm support has been interrupted. Without reminders, an operator may expect normal peripheral monitoring when it is not available; or, may forget to reinstate normal peripheral monitoring when the interruption or need for an interruption (e.g., for maintenance purposes) no longer exists.

At step 810, it is determined whether AlarmMode 316 currently is set to the value ShortSilence. If not, control passes to step 816. If so, local alarm 146 is activated at step 812 using Tone4 as discussed above. In addition, a message is sent to one or more remote alarms 110 with indicia of a request or command to sound Tone3 at each remote alarm. Control passes then by return instruction back to the calling program.

At step 816, it is determined whether AlarmMode 316 currently is set to the value LongSilence. If not, control passes by return instruction back to the calling program. If so, local alarm 146 is activated at step 818 using Tone5 as discussed above. Control passes then by return instruction back to the calling program.

A perimeter monitoring system of the present invention may be advantageously used near an outdoor pool or stream of water. False alarms are dramatically fewer than with conventional systems. For example, systems based on devices that float in the water are more subject to wind variation than systems of the present invention. Systems based on infrared based movement detection in a wide-area are subject to wind, sunlight reflections from the water, and from movement of debris, pets, furniture, toys, or landscaping which may be within the wide-area being monitored. Systems of the present invention accommodate such activity and do not raise a false alarm due in part to mounting of detectors and reflectors, techniques of detection, and signal timing as described above. Systems of the present invention also accommodate pools having automatic cleaning systems without raising a false alarm. As an additional cost saving advantage, systems of the present invention having two emitters are easier to install and maintain than systems having one emitter because one beam typically travels a longer distance than each of two beams and typically undergoes more reflections to return to the monitor.

The foregoing description discusses preferred exemplary embodiments of the present invention, which may be changed or modified without departing from the scope of the present invention. For example, the time periods and tones associated with alerts, warnings, and reminders in variations of the present invention, are adapted to the manner in which the perimeter monitoring system is to be used in a given operating environment.

While for the sake of clarity and ease of description, several specific embodiments of the invention have been described; the scope of the invention is intended to be measured by the claims as set forth below. The description is not intended to be exhaustive or to limit the invention to the form disclosed.

What is claimed is:

1. A perimeter monitoring system comprising:

a. a reflector positioned to receive a beam of light along a segment of a perimeter of an area to be monitored and to provide a returned beam;

b. a monitor comprising:
(1) an emitter that provides the beam of light;
(2) a detector that provides a first signal when an interruption of the returned beam is detected;
(3) an alarm; and
(4) a controller comprising a timer that, when activated, reverts to being inactive after lapse of a period of time, wherein:
(a) the controller activates the alarm to provide a first warning when the timer is active; and
(b) the controller activates the alarm to provide a second warning in response to the first signal when the timer is inactive; and
(c) the controller activates the timer in response to a second signal; and c. a receiver that provides the second signal.

2. The system of claim 1 wherein the second signal identifies the period of time for use by the timer.

3. The system of claim 1 wherein the timer comprises a digital memory device.

4. The system of claim 1 wherein the timer comprises an analog timing circuit.

5. The system of claim 2 wherein:

a. the system further comprises a transmitter that provides a transmitted signal; and b. The receiver provides the second signal in response to the transmitted signal.

6. The system of claim 5 wherein the transmitter is portable.

7. The system of claim 5 wherein the transmitted signal comprises radio frequency energy.

8. A perimeter monitoring system comprising:

a. a reflector positioned to receive a beam of light along a segment of a perimeter of an area to be monitored and to provide a returned beam; and b. a monitor comprising:
(1) an emitter that provides the beam of light when not disabled;
(2) a detector that provides a first signal when an interruption of the returned beam is detected;
(3) an alarm; and
(4) a controller comprising a timer that, when activated, reverts to being inactive after lapse of a period of time, wherein:
(a) the controller activates the alarm to provide an warning in response to the first signal;
(b) the controller activates the timer in response to the first signal; and
(c) the controller disables the emitter when the timer is active.

9. The system of claim 8 wherein the timer comprises a digital memory device.

10. The system of claim 8 wherein the timer comprises an analog timing circuit.

11. A perimeter monitoring system comprising:

a. a reflector positioned to receive a beam of light along a segment of a perimeter of an area to be monitored and to provide a returned beam;

b. a remote alarm comprising a remote transmitter that transmits a status signal and a remote receiver that receives an alert signal and activates a first alarm in response to the alert signal; and c. a monitor comprising:
(1) an emitter that provides the beam of light;
(2) a detector that provides a first signal when an interruption of the returned beam is detected;
(3) a second alarm;
(4) a transmitter that transmits the alert signal in response to the first signal;
(5) a receiver that provides a second signal in response to receiving the status signal; and
(6) a controller comprising a timer that provides a third signal in response to absence of the second signal for a period of time, wherein:
(a) the controller activates the second alarm to provide a first warning in response to the first signal when the timer is active; and
(b) the controller activates the second alarm to provide a second warning in response to the third signal.

12. The system of claim 11 wherein the alert signal is conveyed by light.

* * * * *